US009469014B2

(12) United States Patent
Vogel

(10) Patent No.: US 9,469,014 B2
(45) Date of Patent: Oct. 18, 2016

(54) CONDITIONING DEVICE FOR CONDITIONING A BLADE

(71) Applicant: Wolff Industries, Inc., Spartanburg, SC (US)

(72) Inventor: David Vogel, Columbus, IN (US)

(73) Assignee: Wolff Industries, Inc., Spartanburg, SC (US)

( * ) Notice: Subject to any disclaimer, the term of this patent is extended or adjusted under 35 U.S.C. 154(b) by 100 days.

(21) Appl. No.: 14/090,006

(22) Filed: Nov. 26, 2013

(65) Prior Publication Data

US 2015/0143955 A1 May 28, 2015

(51) Int. Cl.

| | |
|---|---|
| ***B21H 1/02*** | (2006.01) |
| ***B21K 19/00*** | (2006.01) |
| ***B24D 15/08*** | (2006.01) |
| ***B24D 15/06*** | (2006.01) |

(52) U.S. Cl.

CPC ..... *B24D 15/082* (2013.01); *B24D 15/065* (2013.01)

(58) Field of Classification Search

CPC .... B24D 15/06; B24D 15/08; B24D 15/065; B24D 15/082

USPC ..... 76/81–87; 451/545, 486, 549, 555, 556, 451/552; 30/138, 161

See application file for complete search history.

(56) References Cited

U.S. PATENT DOCUMENTS 1,041,631 A * 10/1912 Johnson ..... B24D 15/081 451/45
1,909,743 A * 5/1933 Blankner ..... B24D 15/081 29/DIG. 101
2,519,351 A * 8/1950 Calvert ..... B24B 3/54 451/164
2,598,589 A * 5/1952 Murchison ..... B24D 15/065 451/555
2,955,239 A * 10/1960 Rouse ..... E05C 19/16 211/70.6
3,580,394 A * 5/1971 Elliot ..... B25H 3/04 248/316.3
3,744,902 A * 7/1973 Henker ..... G03F 7/70716 269/58
3,789,896 A * 2/1974 Cooke-Yarborough B25B 15/06 173/93
4,550,632 A * 11/1985 Inman ..... B24D 15/08 451/45
4,934,110 A * 6/1990 Juranitch ..... B24D 15/081 451/486
5,395,033 A * 3/1995 Byrne ..... A61B 17/07207 227/175.1
5,440,953 A * 8/1995 Gangelhoff ..... B24D 15/081 451/486
5,556,327 A * 9/1996 Jenkins ..... B24B 3/48 269/58
5,620,359 A * 4/1997 Harrison ..... B24B 3/54 451/267
5,655,959 A * 8/1997 Juranitch ..... B24D 15/081 451/486
6,881,137 B2 * 4/2005 Friel, Sr. ..... B24D 15/08 451/193

(Continued)

FOREIGN PATENT DOCUMENTS

DE 10044614 A1 * 5/2001 ..... B24B 3/54
DE 10120853 A1 * 10/2002 ..... B24D 15/081

(Continued)

*Primary Examiner* — Ghassem Alie
*Assistant Examiner* — Bharat C Patel
(74) *Attorney, Agent, or Firm* — Dority & Manning, P.A.

(57) ABSTRACT

Conditioning devices for conditioning blades are provided. A conditioning device includes a first rod and a second rod, at least one of the first rod and the second rod rotatable about an axis, the first rod and the second rod oriented to define a blade conditioning zone therebetween, the blade conditioning zone being defined by a blade conditioning angle between the first rod and the second rod. The conditioning device further includes a stationary magnet and a movable magnet. The movable magnet is connected to the one of the first rod and the second rod and rotatable about the axis. The movable magnet has an opposite magnetic orientation relative to the stationary magnet. Rotation of the one of the first rod and the second rod adjusts the blade conditioning angle.

16 Claims, 7 Drawing Sheets

(56) References Cited

U.S. PATENT DOCUMENTS

| | | | | |
|---|---|---|---|---|
| 7,108,595 | B2 * | 9/2006 | Reisinger | B24D 15/081 451/461 |
| 7,172,499 | B2 * | 2/2007 | Eklund | B24D 15/082 451/261 |
| 7,172,500 | B1 * | 2/2007 | Wu | B24D 15/081 451/319 |
| 7,857,681 | B2 * | 12/2010 | Bonapace | B24D 15/082 451/349 |
| 8,221,199 | B2 * | 7/2012 | Smith | B24B 3/54 451/461 |
| 8,282,448 | B2 * | 10/2012 | Loehnert | B24B 3/54 451/486 |
| 8,328,170 | B2 * | 12/2012 | Wasinger | B25B 7/02 269/216 |
| RE43,884 | E * | 1/2013 | Friel, Sr. | B24D 15/065 451/349 |
| 8,864,554 | B2 * | 10/2014 | Masalin | B24D 15/082 451/229 |
| 8,926,408 | B2 * | 1/2015 | Hasegawa | B24D 15/082 451/192 |
| 2005/0217433 | A1 * | 10/2005 | Pretorius | B24D 15/081 76/86 |
| 2007/0281590 | A1 * | 12/2007 | Friel | B24D 15/08 451/45 |
| 2011/0201257 | A1 * | 8/2011 | Walker | B24B 3/54 451/45 |
| 2013/0295823 | A1 * | 11/2013 | Hasegawa | B24D 15/082 451/194 |

FOREIGN PATENT DOCUMENTS

| | | | |
|---|---|---|---|
| EP | WO 2008062052 | * | 9/2008 |
| KR | 992267 B1 | * | 11/2010 |
| KR | WO 2011132868 A2 | * | 11/2010 |

* cited by examiner

CONDITIONING DEVICE FOR CONDITIONING A BLADE

TECHNICAL FIELD

The present disclosure relates to conditioning devices for conditioning blades, and more specifically to conditioning devices which utilize magnetic apparatus.

BACKGROUND

Knives, scissors and other cutting tools are utilized on an everyday basis in a wide variety of situations, ranging from food preparation to various outdoor uses, such as chopping wood, to self-defense. In order to facilitate efficient and effective cutting by the blades of such cutting tools, and to facilitate the safety of users of the blades, the blades should be maintained with sharp, straight cutting edges. Any cutting processes result in the cutting edges of the blades quickly becoming dull and warped, which necessitates periodic conditioning of the blades. For example, blade cutting edges curl with frequent use, and conditioning of the blade to straighten and/or sharpen the cutting edge is required to ensure safe, efficient, and effective use of the blade.

Many tools are available for conditioning blades, which can involve shaping and/or sharpening such blades. Many typically known conditioning devices utilize stationary rods which are positioned to form a blade conditioning zone therebetween at an intersection of the rods. The blade is dragged through the blade conditioning zone and contacts the rods, and this contact between the blade and the rods conditions the blade. However, such stationary rods in many cases do not adequately condition blades, and may not be suitably adaptable to a variety of blades having different sizes and shapes.

Other known conditioning devices include rods which move during use in an attempt to adapt to a variety of blades and provide improved conditioning. Such devices utilize springs or other mechanical devices to bias the rods such that the blade conditioning zone has a suitable angle. However, these mechanical devices are prone to damage and potential failure after periods of use, thus requiring costly repairs or the acquisition of new such devices.

Accordingly, a need currently exists for an improved blade conditioning device. Specifically, an improved blade conditioning device which provides superior conditioning and is adaptable to multiple blade sizes and shapes would be advantageous. Further, an improved blade conditioning device which is less prone to damage or failure due to use is desired.

SUMMARY

Aspects and advantages of the invention will be set forth in part in the following description, or may be obvious from the description, or may be learned through practice of the invention.

In one embodiment, a conditioning device for conditioning a blade is disclosed. The conditioning device includes a first rod and a second rod, at least one of the first rod and the second rod rotatable about an axis, the first rod and the second rod oriented to define a blade conditioning zone therebetween, the blade conditioning zone being defined by a blade conditioning angle between the first rod and the second rod. The conditioning device further includes a stationary magnet and a movable magnet. The movable magnet is connected to the one of the first rod and the second rod and rotatable about the axis. The movable magnet has an opposite magnetic orientation relative to the stationary magnet. Rotation of the one of the first rod and the second rod adjusts the blade conditioning angle.

In another embodiment, a conditioning device for conditioning a blade is disclosed. The conditioning device includes a first rod and a second rod, the first rod rotatable about a first axis and the second rod rotatable about a second axis, the first axis and the second axis generally parallel to each other, the first rod and the second rod oriented to define a blade conditioning zone therebetween, the blade conditioning zone being defined by a blade conditioning angle between the first rod and the second rod. The conditioning device further includes a first stationary magnet and a second stationary magnet, and a first movable magnet and a second movable magnet. The first movable magnet is connected to the first rod and rotatable about the first axis, and the second movable magnet is connected to the second rod and rotatable about the second axis. The first movable magnet has an opposite magnetic orientation relative to the first stationary magnet, and the second movable magnet has an opposite magnetic orientation relative to second stationary magnet. Rotation of the first rod and the second rod adjusts the blade conditioning angle.

In another embodiment, a conditioning device for conditioning a blade is disclosed. The conditioning device includes a plurality of pairs of rotatable first rods and stationary second rods, each first rod rotatable about an axis, each pair of rods oriented to define a blade conditioning zone therebetween, the blade conditioning zone being defined by a blade conditioning angle between the first rod and the second rod of the pair of rods. The conditioning device further includes a plurality of pairs of stationary magnets and movable magnets, each of the plurality of movable magnets connected to one of the first rods and rotatable about the axis, each of the plurality of movable magnets having an opposite magnetic orientation relative to the stationary magnet of the pair of magnets. Rotation of each of the plurality of first rods adjusts the blade conditioning angle of the pair of rods.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
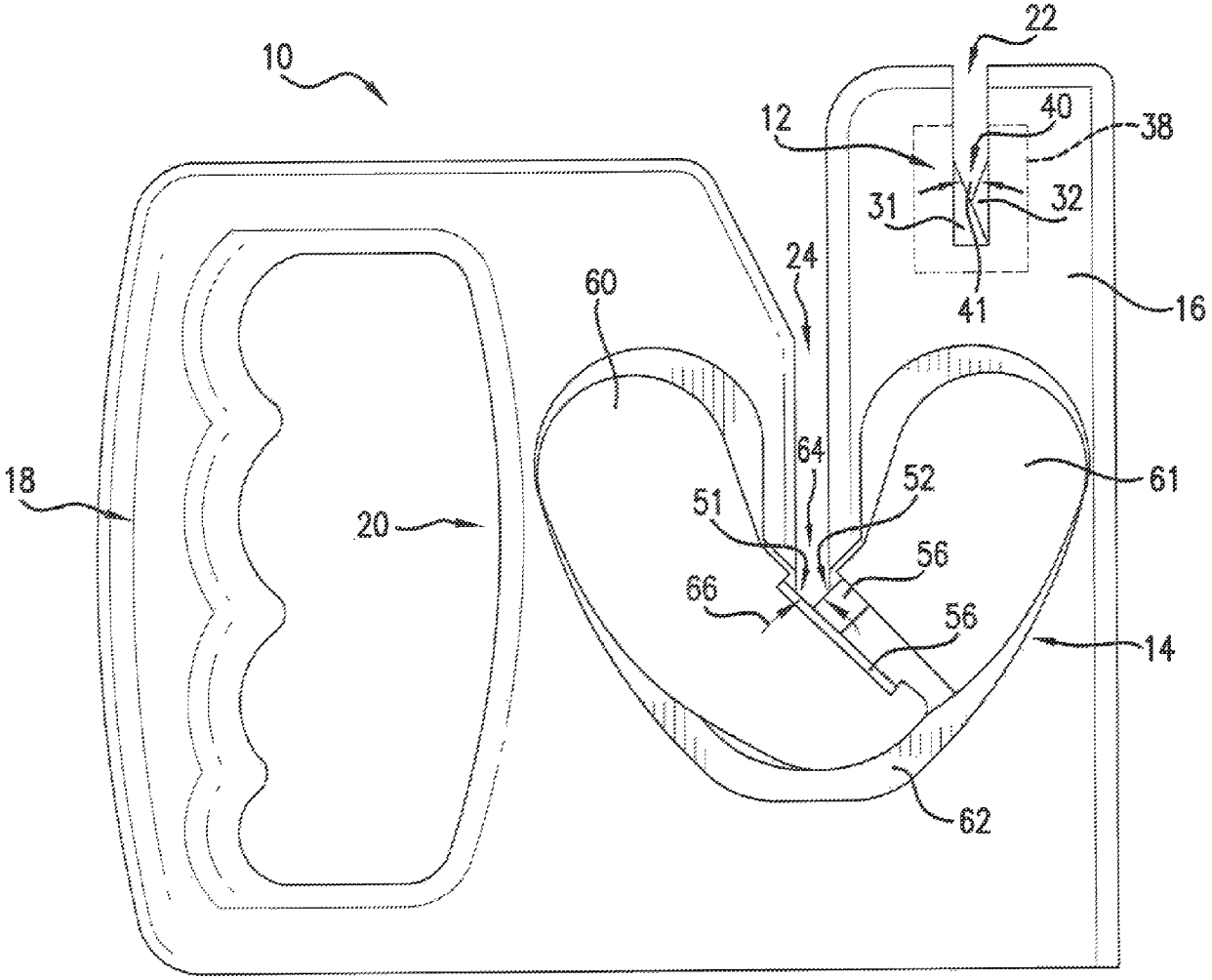
FIG. 1 is a front view of a conditioning device according to one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present disclosure is directed to conditioning devices for blades. The devices may be utilized to condition one or more blades, such as, for example, the blade of a knife or the blades of scissors. It should be understood, however, that the blade of the present disclosure is not limited to knives and scissors, but may be a razor, chisel, axe, hatchet, or any blade or cutting edge known in the art. Further, it should be understood that the blade of the present disclosure may be a straight-edged blade, serrated-edge blade, or a blade with any other edge design known in the art. A conditioning device of the present disclosure may interact with the blade to condition the blade, such as, for example, by straightening and/or sharpening the blade.

Figure 2:
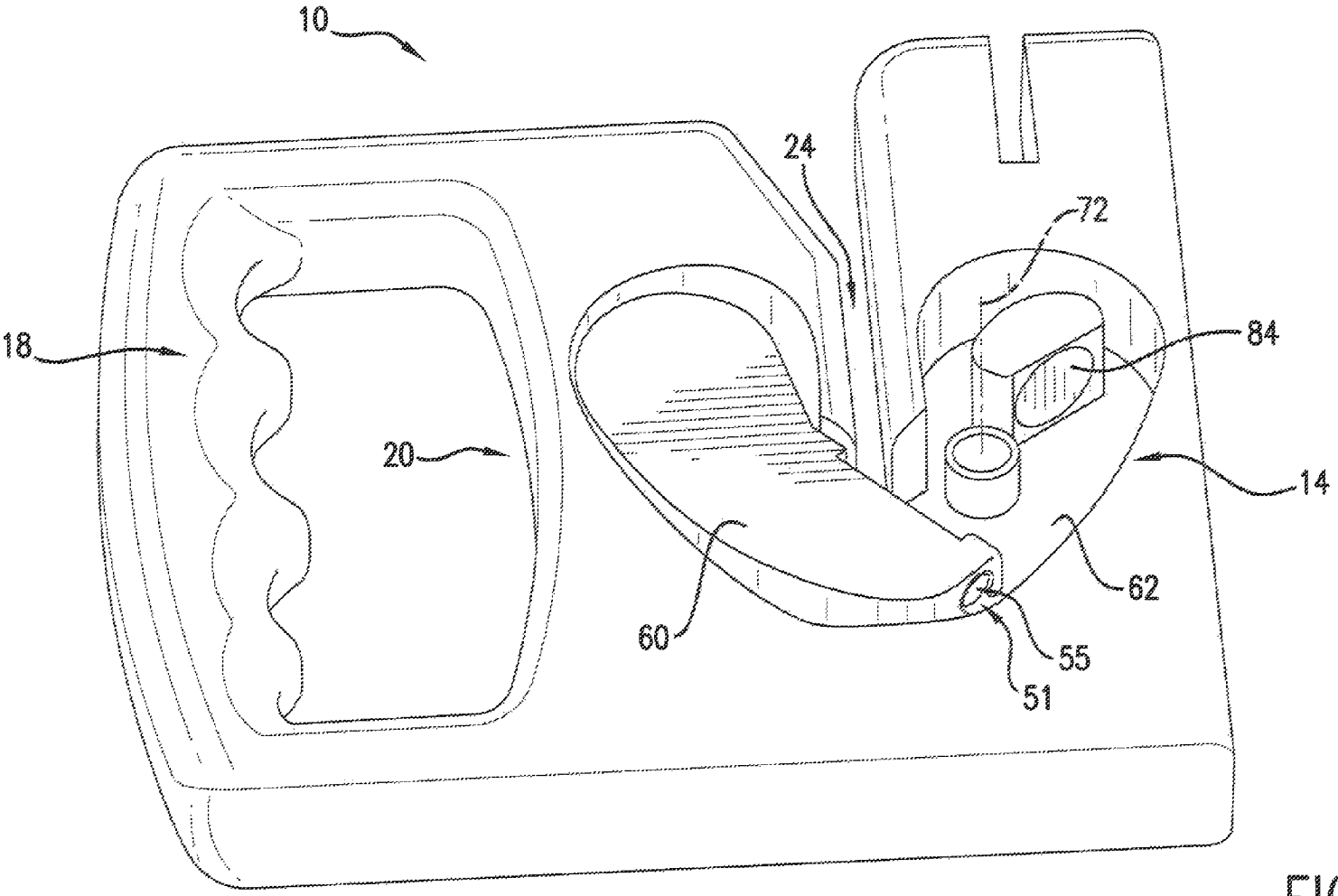
FIG. 2 is a front perspective view of a conditioning device with a movable portion removed to illustrate a stationary portion according to one embodiment of the present disclosure.

Referring to FIGS. 1 and 2, a conditioning device 10 is illustrated. The conditioning device 10 may include, for example, a first conditioning assembly 12 and a second conditioning assembly 14. The first and second conditioning assemblies 12, 14 may have different uses and applications as desired. For example, in exemplary embodiments, the first conditioning assembly 12 may be utilized to straighten a blade, while the second conditioning assembly 14 may be utilized to sharpen a blade.

First and second conditioning assemblies 12, 14 may, for example be housed by a casing 16 of the device 10. The casing 16 may be formed from any suitable material, such as in exemplary embodiments a suitable plastic. The various components on the device 10, such as the components of the first conditioning assembly 12 and second conditioning assembly 14, may be connected to the casing 16. The casing 16 may include, for example, a handle 18 and a conditioning portion 20. The handle 18 may allow a user to grip the device 10 during use and/or for transport, while the conditioning portion 20 may include the various conditioning assemblies 12, 14 thereon. It should be understood, however, that the present disclosure is not limited to hand-held devices 10 which include handles 18 as illustrated. Rather, and suitably sized device 10, ranging from small hand-held devices 10 with or without handles 18 to large industrial size devices 10, is within the scope and spirit of the present disclosure.

The casing 16 may further define one or more channels, through which blades may be drawn and placed into contact with various conditioning apparatus, such as components of the first conditioning assembly 12 and/or second conditioning assembly 14. For example, as illustrated, a first channel 22 and a second channel 24 are defined in and by the casing 16. As discussed herein, the first conditioning assembly 12 may be positioned relative to the first channel 22, and the second conditioning assembly 14 may be positioned relative to the second channel 24, such that blades can be drawn through the channels 22, 24 for contact with the conditioning assemblies 12, 14.

Figure 5:
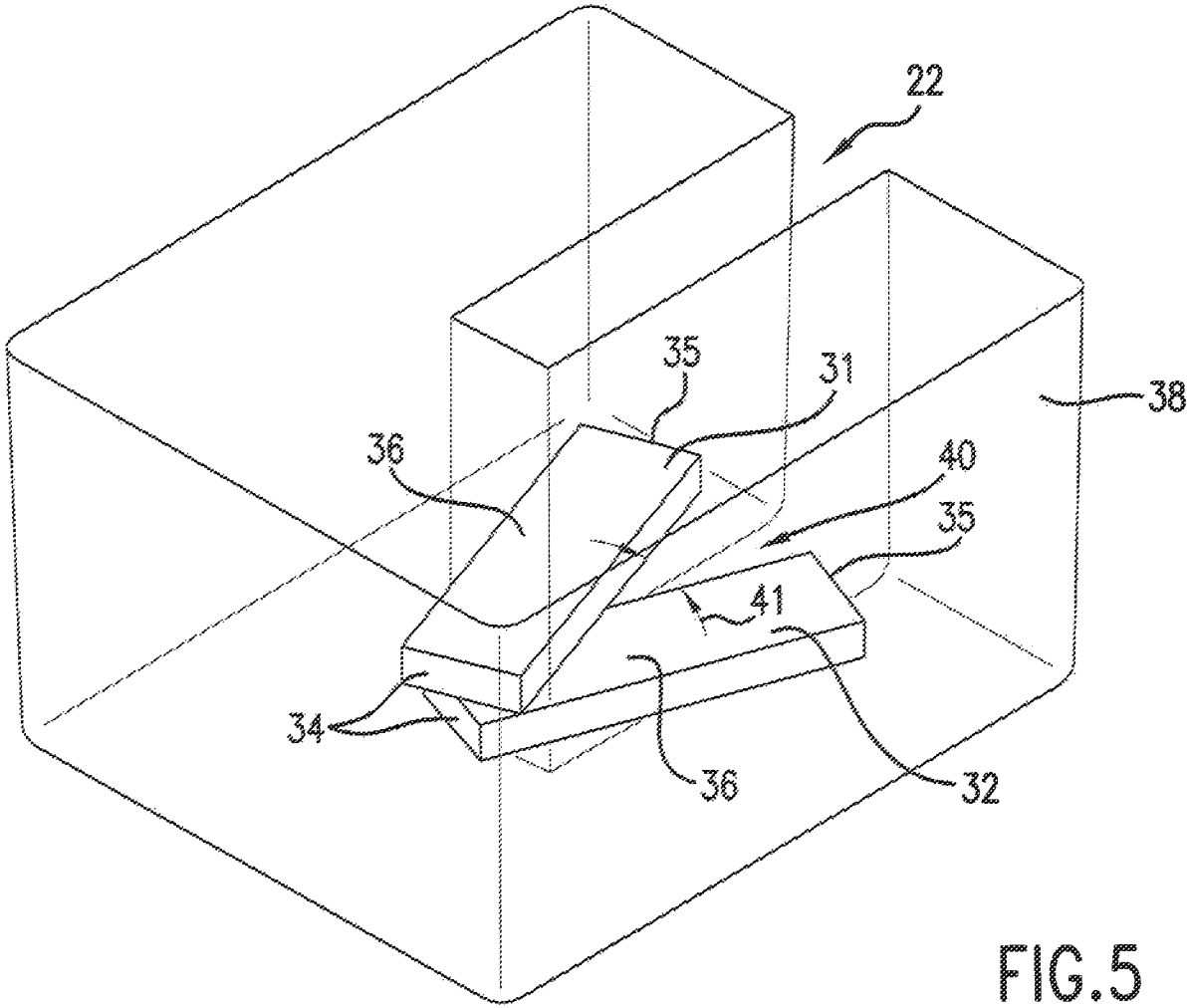
FIG. 5 is a sectional view of a first conditioning assembly of a conditioning device in a closed position according to one embodiment of the present disclosure.

Referring now to FIGS. 1 and 5, a first conditioning assembly 12 is illustrated. First conditioning assembly 12 in exemplary embodiments may be utilized to straighten blades, although alternatively such assembly 12 may be utilized to steel and/or otherwise manipulate blades as desired or required. As illustrated, first conditioning assembly 12 may include a plurality of rods, such as first rod 31 and second rod 32. First and second rods 31, 32 in exemplary embodiments may be stationary rods which, for example, may be fixidly connected to the casing 16 as shown. Each rod may include a first end 34, a second end 35, and a shaft 36. The shaft 36 and rod 31, 32 generally may have any suitable cross-sectional shape, such as circular or oval, rectangular or square, triangular, or any other suitable polygonal shape. Each rod may further extend across the first channel 22, such that that a portion of the shaft 36 thereof may be exposed in the channel 22 for contact with blades. The first ends 34 and second ends 35 may be fixidly connected within the casing 16, such as through embedding therein.

The rods 31 and 32 may be formed from any suitable material known in the art for conditioning blades. For example, if desired, the rods 31 and 32 may be tungsten carbide rods. Tungsten carbide may be particularly suitable for straightening blades. Alternatively, the rods 31 and 32 may be, for example, hardened steel rods, carbon steel rods, stainless steel rods, tool steel rods, or ceramic rods. The rods 31 and 32 may further include any coating known in the blade conditioning art. For example, if desired, the rods 31 and 32 may include a thermal diffusion coating applied thereon. A thermal diffusion process may be utilized to obtain the thermal diffusion coating, wherein a reaction between diffusion materials and carbon contained in the rods causes a layer or layers of carbide to be diffused onto the surface of the rods. Alternatively, the rods 31 and 32 may include, for example, a sand blast coating or a bead blast coating. A sand blast coating is applied using a process wherein sand or oilier materials are applied to the surface of the rods to remove surface deposits from the rods. A bead blast coating is applied using a process wherein beads of glass or other similar materials are applied to the surface of the rods to remove surface deposits from the rods.

The first ends 34 and the second ends 35 of the rods 31 and 32 may be embedded within the casing 16 according to any process known in the art. For example, passages may be drilled or bored into the casing 16, and the rods 31 and 32 may be inserted through the passages. For example, the rods 31 and 32 may be press-fit into the passages. An adhesive and/or an anti-bacterial substance can be applied to the passages and the rods 31 and 32 to seal the rods 31 and 32 in the passages. In another embodiment, the rods 31 and 32 may be placed in a mold, and the casing 16 may be injection molded around the rods 31 and 32. In yet another embodiment, the casing 16 may be injection molded around pins that form passages for the rods 31 and 32. The pins may then be drawn out of the cutting board, and the rods 31 and 32 may be press-fit into the passages in the casing 16. Further, for example, the rods 31 and 32 can be sealed into the passages using a thermal heat seal.

In some embodiments as illustrated, the rods 31, 32 can be embedded in a housing 38 that is embedded in the casing 16. The housing 28 may be formed from any suitable material, which may be similar to or dissimilar from the casing 16 material. The housing 38 in these embodiments may additionally define the first channel 22 therein when embedded in the casing 16.

The first rod 31 and the second rod 32 may be oriented to define a blade conditioning zone 40 between the first rod 31 and the second rod 32. The blade conditioning zone 40 may be defined by a blade conditioning angle 41, as shown in FIGS. 1 and 2. The blade conditioning angle 41 may be any angle known in the art for conditioning a blade. For example, if desired, the blade conditioning angle 41 may be in the range from about 15 degrees to about 45 degrees. In one embodiment, the blade conditioning angle 41 may be about 32.5 degrees. In another embodiment, the blade conditioning angle 41 may be about 22 degrees. In yet another embodiment, the blade conditioning angle 41 may be about 16 degrees. The blade conditioning angle 41 and the blade conditioning zone 40 may be configured and disposed to interact with and condition a blade as the blade is drawn through the channel 22. For example, as the blade is drawn through the channel, the cutting edge of the blade may contact the first conditioning assembly 12 in the blade conditioning zone 40. The blade conditioning zone 40 may act to condition the blade by straightening, steeling, or otherwise manipulating the cutting edge of the blade.

Referring now to FIGS. 1 through 4, a second conditioning assembly 14 is illustrated. Second conditioning assembly 14 in exemplary embodiments may be utilized to steel blades, although alternatively such assembly 14 may be utilized to straighten and/or otherwise manipulate blades as desired or required. As illustrated, second conditioning assembly 14 may include a plurality of rods, such as first rod 51 and second rod 52. First and/or second rods 51, 52 in exemplary embodiments may be movable rods which, for example, may be movable connected to the casing 16 as shown and as discussed herein. Each rod may include a first end 54, a second end 55, and a shaft 56. The shaft 56 and rod 51, 52 generally may have any suitable cross-sectional shape, such as circular or oval, rectangular or square, triangular, or any other suitable polygonal shape. Each rod may further extend across the second channel 24, such that that a portion of the shaft 56 thereof may be exposed in the channel 24 for contact with blades.

The rods 51 and 52 may be formed from any suitable material known in the art for conditioning blades. For example, if desired, the rods 51 and 52 may be hardened steel rods. Hardened may be particularly suitable for steeling blades. Alternatively, the rods 51 and 52 may be, for example, tungsten carbide rods, carbon steel rods, stainless steel rods, tool steel rods, or ceramic rods. The rods 51 and 52 may further include any coating known in the blade conditioning art. For example, if desired, the rods 51 and 52 may include a thermal diffusion coating applied thereon. A thermal diffusion process may be utilized to obtain the thermal diffusion coating, wherein a reaction between diffusion materials and carbon contained in the rods causes a layer or layers of carbide to be diffused onto the surface of the rods. Alternatively, the rods 51 and 52 may include, for example, a sand blast coating or a bead blast coating. A sand blast coating is applied using a process wherein sand or other similar materials are applied to the surface of the rods to remove surface deposits from the rods. A bead blast coating is applied using a process wherein beads of glass or other similar materials are applied to the surface of the rods to remove surface deposits from the rods.

The first ends 54 and the second ends 55 of the rods 51 and 52 may be attached to the casing 16. For example, as illustrated, the rods 51, 52 may be embedded in shells, such as first shell 60 and second shell 61, which at least partially surrounds the respective rods 51, 52, such as the first and second ends 54, 55 thereof. The casing 16 may define one or more trenches 62 therein, such as in the surface thereof, in which the shells 60, 61 may be disposed, thus positioning the rods 51, 52 as required. Further, as discussed herein, one or more shells 60, 61 may be movable to facilitate movement of the rods 51, 52.

Figure 3:
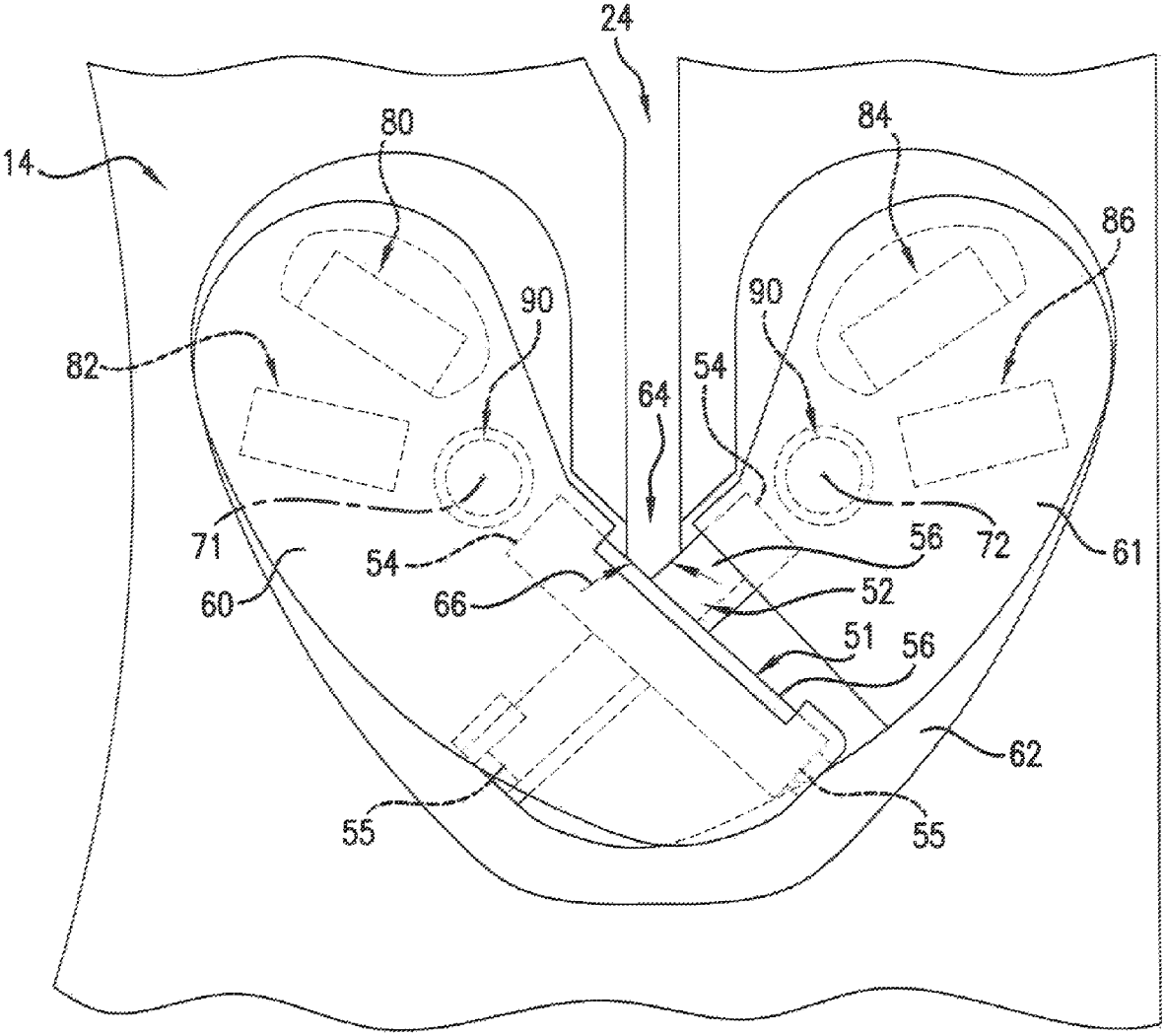
FIG. 3 is a sectional view of a second conditioning assembly of a conditioning device in an open position according to one embodiment of the present disclosure.
Figure 4:
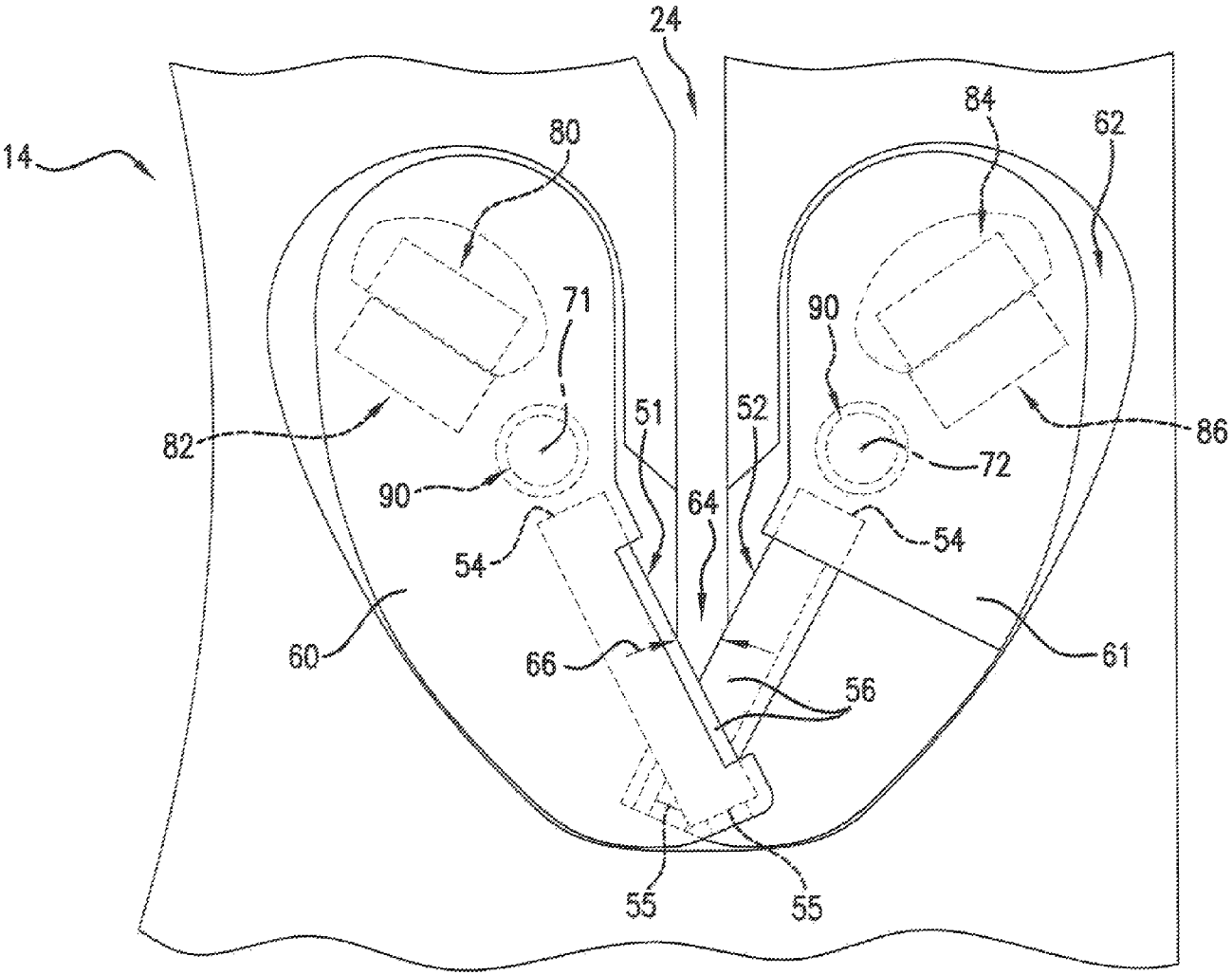
FIG. 4 is a sectional view of a second conditioning assembly of a conditioning device in a closed position according to one embodiment of the present disclosure.

The first rod 51 and the second rod 52 may be oriented to define a blade conditioning zone 64 between the first rod 51 and the second rod 52. The blade conditioning zone 64 may be defined by a blade conditioning angle 65, as shown in FIGS. 1, 3 and 4. Further, as discussed herein, the blade conditioning angle 65 may be adjustable. The blade conditioning angle 64 and the blade conditioning zone 66 may be configured and disposed to interact with and condition a blade as the blade is drawn through the channel 24. For example, as the blade is drawn through the channel, the cutting edge of the blade may contact the second conditioning assembly 14 in the blade conditioning zone 64. The blade conditioning zone 64 may act to condition the blade by straightening, steeling, or otherwise manipulating the cutting edge of the blade.

As mentioned, and referring still to FIGS. 1 through 4, one or both of the first rod 51 and second rod 52 of the second conditioning assembly 14 may be rotatable about an axis. For example, as illustrated, both rods 51, 52 may be rotatable about an axis. Rod 51 may be rotatable about a first axis 71, while rod 52 may be rotatable about a second axis 72, as illustrated. Further, the axes 71, 72 may in exemplary embodiments be parallel, such that rotation of the rods 51, 52 are generally about such parallel axes 71, 72.

Further, magnets may be utilized to facilitate rotation of the rods 51, 52. For example, one or more stationary magnets and one or more movable magnets may be utilized with the second conditioning assembly 14. A pair of magnets comprising a stationary magnet and a movable magnet may be utilized to facilitate rotation of a rod, such as rod 51 or rod 52. A first stationary magnet 80 and a first movable magnet 82 may be utilized to facilitate rotation of the first rod 51, while a second stationary magnet 84 and second movable magnet 86 may be utilized to facilitate rotation of the second rod 52. As shown for example in FIGS. 2 through 4, a stationary magnet 80, 84 may be embedded in casing 16. A movable magnet 82, 86 may be connected to a movable rod 51, 52, such as by a shell 60, 61 which at least partially surrounds and connects the movable magnet 82, 86 with the movable rod 51, 52. The magnet 82, 86 may, for example, be embedded in the shell 60, 61 along with the rod 51, 52, thus connecting the magnet 82, 86 and rod 51, 52. Shell 60, 61 may additionally be connected to the casing 16, such as through use of a mechanical fastener 90 such as a screw, nut/bolt combination, rivet, etc. The mechanical fastener 90 may additionally define the axis 71, 72 about which the rod 51, 52 may rotate. Thus, the shell 60, 61, magnet 82, 86 and rod 51, 52 all rotate about such axes 71, 72 defined by the mechanical fastener 90.

To facilitate movement of the rods 51, 52, movable magnet 82, 86 may have an opposite magnetic orientation relative to the stationary magnet 80, 84 that the movable magnet 82, 86 is paired with. Thus, for example, the polarities of the sides of the magnets 80, 82 and 84, 86 which approach and may contact one another as illustrated in FIG. 4 are opposite, and the magnets 80, 82 and 84, 86 may thus repel each other. As further illustrated, due to the location of the rods 51, 52 relative to the magnets 80, 82 and 84, 86, rotation of the rods 51, 52 may be biased to cause the blade conditioning angle 66 to increase due to interaction between the stationary magnet 80, 84 and the movable magnet 82, 86. For example, rods 51, 52 may be movable between generally open positions, as illustrated in FIG. 3, and generally closed positions, as illustrated in FIG. 4. In the open positions, the magnets 80, 82 and 84, 86 may be spaced from each other relative to the closed position and the blade conditioning angle 66 may be greater than in the closed position. In the closed positions, the magnets 80, 82 and 84, 86 may be proximate, and even in contact with, each other relative to the open position and the blade conditioning angle 66 may be less than in the closed position. Due to the orientation of the magnets 80, 82 and 84, 86, rotation of the rods 51, 52 may be biased towards the open position.

Thus, rotation of the rods 51, 52, facilitated by the pairs of magnets 80, 82 and 84, 86, may adjust the blade conditioning angle 66. Use of magnets 80, 82, 84, 86 to facilitate movement of the rods 51, 52 may advantageously allow the second conditioning assembly 14 and conditioning device 10 in general to adapt to a variety of blades and exhibit improved conditioning characteristics. Further, the use of magnets eliminates the risks of damage or failure associated with springs, etc. previously utilized to facilitate such movement.

Figure 6:
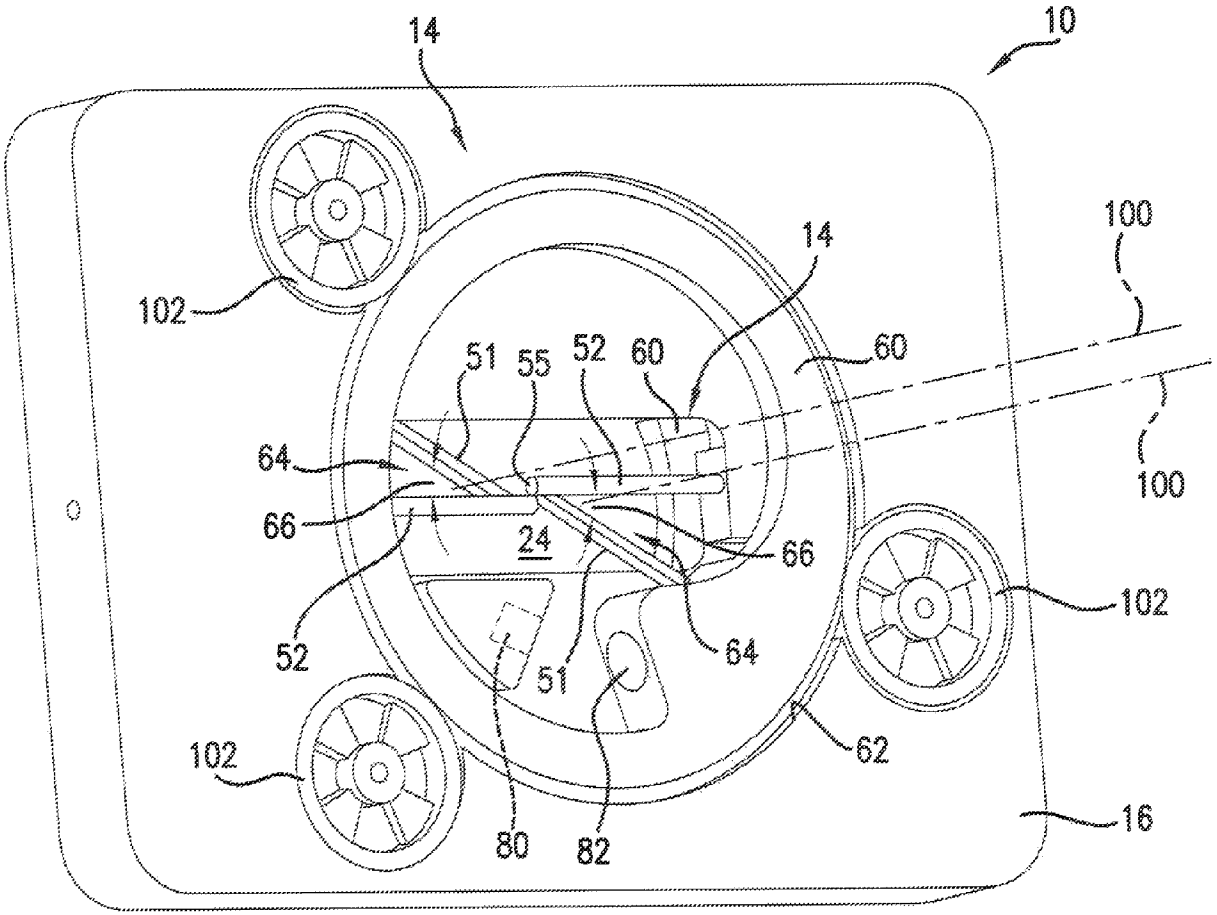
FIG. 6 is a perspective view of a conditioning device according to another embodiment of the present disclosure.
Figure 7:
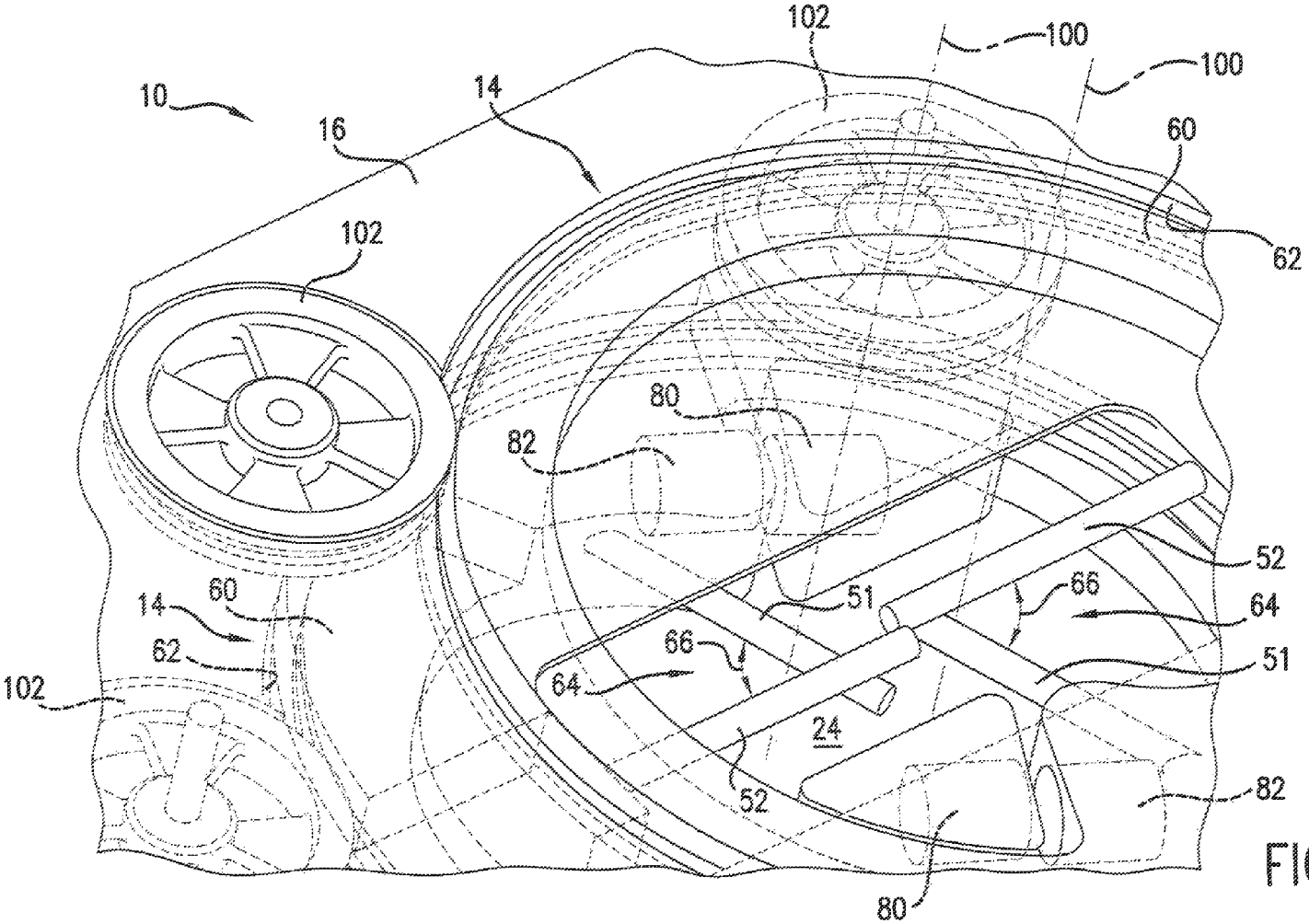
FIG. 7 is a sectional view of a conditioning device according to another embodiment of the present disclosure.

Referring now to FIGS. 6 and 7, additional embodiments of the conditioning device 10 of the present disclosure are illustrated. In these embodiments, multiple second conditioning assemblies 14, such as two in the embodiment illustrated, may be utilized. Further, as illustrated, the first rod 51 of each second conditioning assembly 14 may be rotatable, while the second rod 52 may be stationary (or vice versa). By providing multiple second conditioning assemblies 14, conditioning devices 10 may facilitate conditioning of devices with multiple blades, such as scissors.

As illustrated, first rods 51, such as the first ends 54 thereof, may be embedded in shells 60, which in the embodiments illustrated may be generally circular. Second ends 55 may extend from the shells 60. Movable magnets 82 may additionally be embedded in the shells 60, while stationary magnets 80 may be embedded in the casing 16. The shells 60, and thus the rods 51 and magnets 82, may rotate about central axes 100.

Rotatable wheels 102 may facilitate movement of the shells 60, each of which may be disposed in a trench 62, about the respective axes 100. Such rotatable wheels 102 may be connected to the casing 16 and in contact with the shells 60, and may guide the rotational movement of the shells 60 in the trenches 62. In some embodiments as illustrated, trenches 62 may be defined in opposing sides of the casing 16, and the shells 60 may be rotatable in opposing directions in the trenches 62.

Second rods 52, as illustrated, may be stationary. First ends 54 of the second rods 52 may be embedded in the casing 16, while second ends 55 extend therefrom.

Rotation of the first rods 51 relative to the second rods 52 may adjust the blade conditioning angle 66. Such rotation may be facilitated by the opposite magnetic orientation of the magnets 80, 82 associated with the first rods 51. Notably, as illustrated, due to the location of the rods 51 relative to the magnets 80, 82, rotation of the rods 51 may be biased to cause the blade conditioning angle 66 to decrease due to interaction between the stationary magnet 80 and the movable magnet 82. For example, rods 51 may be movable between generally open positions, as illustrated in FIG. 6, and generally closed positions, as illustrated in FIG. 7. In the open positions, the magnets 80, 82 may be spaced from each other relative to the closed position and the blade conditioning angle 66 may be less than in the closed position. In the closed positions, the magnets 80, 82 may be proximate, and even in contact with, each other relative to the open position and the blade conditioning angle 66 may be greater than in the closed position. Due to the orientation of the magnets 80, 82, rotation of the rods 51, 52 may be biased towards the open position.

It should be understood that in alternative embodiments, first rods 51 may be stationary, and second rods 52 may be movable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A conditioning device for conditioning a blade, the conditioning device comprising:

a first rod and a second rod, at least one of the first rod and the second rod rotatable about an axis, the first rod and the second rod oriented to define a blade conditioning zone therebetween, the blade conditioning zone being defined by a blade conditioning angle between the first rod and the second rod;

a stationary magnet;

a movable magnet connected to the one of the first rod and the second rod and rotatable about the axis, the movable magnet having an opposite magnetic orientation relative to the stationary magnet; and a shell at least partially surrounding and connecting the movable magnet and the one of the first rod and the second rod and defining the axis, wherein the axis is disposed between the one of the first rod and the second rod and the movable magnet along a length of the shell, the length being the greatest dimension of the shell, and wherein rotation of the one of the first rod and the second rod adjusts the blade conditioning angle, and wherein rotation of the one of the first rod and the second rod such that the blade conditioning angle decreases causes rotation of the movable magnet towards the stationary magnet.

2. The conditioning device of claim 1, wherein rotation of the one of the first rod and the second rod is biased to cause the blade conditioning angle to increase due to interaction between the stationary magnet and the movable magnet.

3. The conditioning device of claim 1, further comprising a casing, the casing defining a trench, the shell disposed in the trench.

4. The conditioning device of claim 3, wherein the shell is connected to the casing by a mechanical fastener, the mechanical fastener defining the axis, the shell rotatable about the axis.

5. The conditioning device of claim 3, wherein the shell is rotatable about a central axis.

6. The conditioning device of claim 5, wherein the casing defines a channel, and wherein the first rod and the second rod are positioned such that the blade conditioning zone is located in the channel.

7. The conditioning device of claim 3, wherein the casing comprises a handle.

8. The conditioning device of claim 1, wherein the first rod, second rod, stationary magnet, and movable magnet comprise a second conditioning assembly, and further comprising a first conditioning assembly comprising a first rod and a second rod, the first rod and second rod stationary and defining a blade conditioning zone therebetween.

9. The conditioning device of claim 8, wherein the first rod and the second rod of the first conditioning assembly are formed from tungsten carbide.

10. The conditioning device of claim 1, wherein the first rod and the second rod are formed from hardened steel.

11. The conditioning device of claim 1, wherein the first rod and the second rod are rotatable.

12. The conditioning device of claim 1, wherein the first rod is rotatable and the second rod is stationary.

13. The conditioning device of claim 1, wherein the first rod is a plurality of first rods and the second rod is a plurality of second rods.

14. A conditioning device for conditioning a blade, the conditioning device comprising:

a first rod and a second rod, the first rod rotatable about a first axis and the second rod rotatable about a second axis, the first axis and the second axis generally parallel to each other, the first rod and the second rod oriented to define a blade conditioning zone therebetween, the blade conditioning zone being defined by a blade conditioning angle between the first rod and the second rod;

a first stationary magnet and a second stationary magnet;

a first movable magnet and a second movable magnet, the first movable magnet connected to the first rod and rotatable about the first axis, the second movable magnet connected to the second rod and rotatable about the second axis, the first movable magnet having an opposite magnetic orientation relative to the first stationary magnet, the second movable magnet having an opposite magnetic orientation relative to second stationary magnet; and a first shell and a second shell, the first shell at least partially surrounding and connecting the first movable magnet and the first rod and defining the first axis, the second shell at least partially surrounding and connecting the second moveable magnet and the second rod and defining the second axis, wherein the first axis is disposed between the first rod and the first movable magnet along a length of the first shell, the length being the greatest dimension of the first shell, wherein the second axis is disposed between the second rod and the second movable magnet along a length of the second shell, the length being the greatest dimension of the second shell, and wherein rotation of the first rod and the second rod adjusts the blade conditioning angle, and wherein rotation of the first rod and the second rod such that the blade conditioning angle decreases causes rotation of the first movable magnet towards the stationary magnet and rotation of the second movable magnet towards the stationary magnet.

15. The conditioning device of claim 14, wherein rotation of the first rod and the second rod is biased to cause the blade conditioning angle to increase due to interaction between the first stationary magnet and the first movable magnet and interaction between the second stationary magnet and the second movable magnet.

16. The conditioning device of claim 14, wherein the first rod, second rod, first stationary magnet, second stationary magnet, first movable magnet and second movable magnet comprise a second conditioning assembly, and further comprising a first conditioning assembly comprising a first rod and a second rod, the first rod and second rod stationary and defining a blade conditioning zone therebetween.

* * * * *